US011925273B2

(12) United States Patent
Sin et al.

(10) Patent No.: US 11,925,273 B2
(45) Date of Patent: Mar. 12, 2024

(54) ARMREST FOR CHAIR

(71) Applicant: SECRETLAB SG PTE. LTD., Singapore (SG)

(72) Inventors: Vincent Sin, Singapore (SG); Jon Hao Chan, Singapore (SG); Elroy Cheng Feng Lee, Singapore (SG)

(73) Assignee: SECRETLAB SG PTE. LTD., Singapore (SG)

( * ) Notice: Subject to any disclaimer, the term of this patent is extended or adjusted under 35 U.S.C. 154(b) by 0 days.

(21) Appl. No.: 17/717,392

(22) Filed: Apr. 11, 2022

(65) Prior Publication Data

US 2022/0322835 A1 Oct. 13, 2022

(30) Foreign Application Priority Data

Apr. 12, 2021 (CN) ..... 202120730172.X
Apr. 8, 2022 (CN) ..... 202220804963.7

(51) Int. Cl.
*A47C 7/54* (2006.01)
*A47C 31/00* (2006.01)
*A47C 31/02* (2006.01)

(52) U.S. Cl.
CPC ..... *A47C 7/54* (2013.01); *A47C 31/003* (2013.01); *A47C 31/02* (2013.01)

(58) Field of Classification Search
CPC ..... A47C 7/54; A47C 7/541; A47C 7/543; A47C 7/546; A47C 31/003; A47C 31/02
See application file for complete search history.

(56) References Cited

U.S. PATENT DOCUMENTS 3,074,762 A 1/1963 Samuel
6,017,091 A * 1/2000 Cao ..... A47C 1/03 297/411.37
6,755,473 B2 * 6/2004 Reed ..... A47C 7/54 297/411.36
6,843,534 B2 * 1/2005 Lee ..... A47C 7/54 297/411.36
6,974,189 B2 * 12/2005 Machael ..... A47C 1/03 297/411.36
7,159,947 B1 * 1/2007 Lee ..... A47C 1/0308 297/411.37
7,201,449 B2 * 4/2007 Tsai ..... A47C 1/0308 297/411.36

(Continued)

OTHER PUBLICATIONS

Extended European Search Report for EP Appl. No. 22167846.9, dated Sep. 2, 2022.

(Continued)

*Primary Examiner* — Rodney B White
(74) *Attorney, Agent, or Firm* — Foley & Lardner LLP

(57) ABSTRACT

An armrest for a chair includes a first member and a second member. The first member includes a body extending in a longitudinal direction from a first end to a second end. The body includes one or more recesses. The first member also includes one or more magnets disposed in the one or more recesses. The second member is releasably attached to the first member. The second member includes a cavity configured to receive the first member and one or more magnetizable plate members disposed in the cavity. The one or more magnetizable plate members are adjacent the one or more magnets when the first member is received in the cavity.

18 Claims, 7 Drawing Sheets

(56) References Cited

U.S. PATENT DOCUMENTS

| | | | | |
|---|---|---|---|---|
| 7,387,341 | B1 * | 6/2008 | Tsai | A47C 1/0307<br>297/411.37 |
| 8,246,117 | B2 * | 8/2012 | Melhuish | A47C 1/0308<br>297/411.37 |
| 9,004,603 | B1 * | 4/2015 | Wang | A47C 1/03<br>297/411.36 |
| 9,320,360 | B2 * | 4/2016 | Bauer | A47C 1/03 |
| 9,592,757 | B2 * | 3/2017 | Machael | B60N 2/767 |
| 9,907,403 | B2 * | 3/2018 | Lin | A47C 1/03 |
| 11,641,946 | B2 * | 5/2023 | Antonucci | A47C 7/541<br>248/118 |
| 2008/0104807 | A1 * | 5/2008 | Hosfeld | A47C 21/022<br>24/455 |
| 2022/0031079 | A1 | 2/2022 | Antonucci | |

OTHER PUBLICATIONS

Examination Report for EP Appl. No. 22167846.9 dated Jul. 4, 2023.

* cited by examiner

ARMREST FOR CHAIR

CROSS-REFERENCE TO RELATED APPLICATIONS

The present application claims priority to and the benefit of CN Patent Application No. 202120730172.X, titled "An Armest", and filed on Apr. 12, 2021, and CN Patent Application No. 202220804963.7, titled "ARMREST FOR CHAIR," and filed on Apr. 8, 2022, the entire contents of all of which are herein incorporated by reference in their entirety.

FIELD OF INVENTION

The present invention relates broadly, but not exclusively, to an armrest for a chair.

BACKGROUND

Chairs commonly used in offices or homes are designed with features to provide comfort to users. One such feature is an armrest to allow a user to comfortably rest his/her arm. A typical chair has armrests fixedly attached to the arm support portions and a user typically uses the same armrests throughout the lifetime of the chair. However, wear and tear of the armrests will inevitably occur. In certain circumstances, the armrests may wear out faster than the other portions of the chair and it is not economical to replace the entire chair.

Further, as the armrests are typically fixedly attached to the arm support portions of a chair, the chair can only be assembled with armrests of a particular design. In other words, there are no provisions for a user to select armrests of his/her choice. However, different users may have their own preferences with respect to the design, material, texture, etc. of the armrests.

Some current armrests may include a memory foam material which is typically a one-material injection molded polyurethane foam with a single integral skin. However, the armrests may have covers that may not be properly and securely integrated into the chair. In addition, user comfort may be compromised due to the integration of different armrest parts. For example, the material differences between the soft memory foam and the hard plastic housing may be obvious.

A need therefore exists to provide an armrest for a chair that seeks to address at least some of the above problems.

SUMMARY

According to a first aspect, there is provided an armrest for a chair, comprising: a first member, the first member comprising: a body extending in a longitudinal direction from a first end to a second end, the body comprises one or more recesses; and one or more magnets disposed in the one or more recesses; and a second member releasably attached to the first member, the second member comprising: a cavity configured to receive the first member; and one or more magnetizable plate members disposed in the cavity, the one or more magnetizable plate members are adjacent the one or more magnets when the first member is received in the cavity.

The second member may comprise a shell and a cover disposed on the shell, the shell defining the cavity.

The one or more magnetizable plate members may be fixedly attached to the shell, and the one or more magnets may be securely retained in the one or more recesses.

The cover may be releasably attached to the shell.

The cover may be fixedly attached to the shell.

The shell may comprise nylon-glass fiber composite and the cover disposed on the shell may comprise polyurethane foam.

The shell may comprise nylon-glass fiber composite and the cover disposed on the shell may comprise thermoplastic polyurethane.

The body of the first member may comprise a geometry matching a geometry of the cavity for retaining the first member against lateral movement when the first member is received in the cavity.

According to another aspect, there is provided an armrest for a chair, comprising: a first member having a body comprising one or more recesses, each of the one or more recesses configured to securely retain a corresponding magnet; and a second member releasably attached to the first member, the second member comprising: a bottom housing defining a cavity, the cavity configured to receive the first member; one or more magnetizable plate members disposed in the cavity, the one or more magnetizable plate members being adjacent the one or more magnets when the first member is received in the cavity; a rim member disposed on a periphery of the bottom housing; and a cushion member disposed on the rim member and configured to abut at least a surface of the bottom housing forming the cavity to snugly fit over the bottom housing.

The cushion member may be made of a memory foam material.

The second member may further comprise a base plate disposed at a lower surface of the cushion member and configured to abut the surface of the bottom housing forming the cavity. The base plate is removably attached to the cushion member.

The rim member and the bottom housing may be made from the same material.

The rim member and the bottom housing may have different surface finishes.

The rim member and the bottom housing may have different colours.

The bottom housing may comprise a plurality of protrusions disposed along the periphery. The rim member may comprise a corresponding plurality of grooves configured to receive the plurality of protrusions of the bottom housing to securely attach the rim member to the bottom housing.

The second member may further comprise an upholstery configured to cover the cushion member.

BRIEF DESCRIPTION OF THE DRAWINGS

Embodiments and implementations are provided by way of example only, and will be better understood and readily apparent to one of ordinary skill in the art from the following written description, read in conjunction with the drawings, in which.

DETAILED DESCRIPTION

Figure 1A:
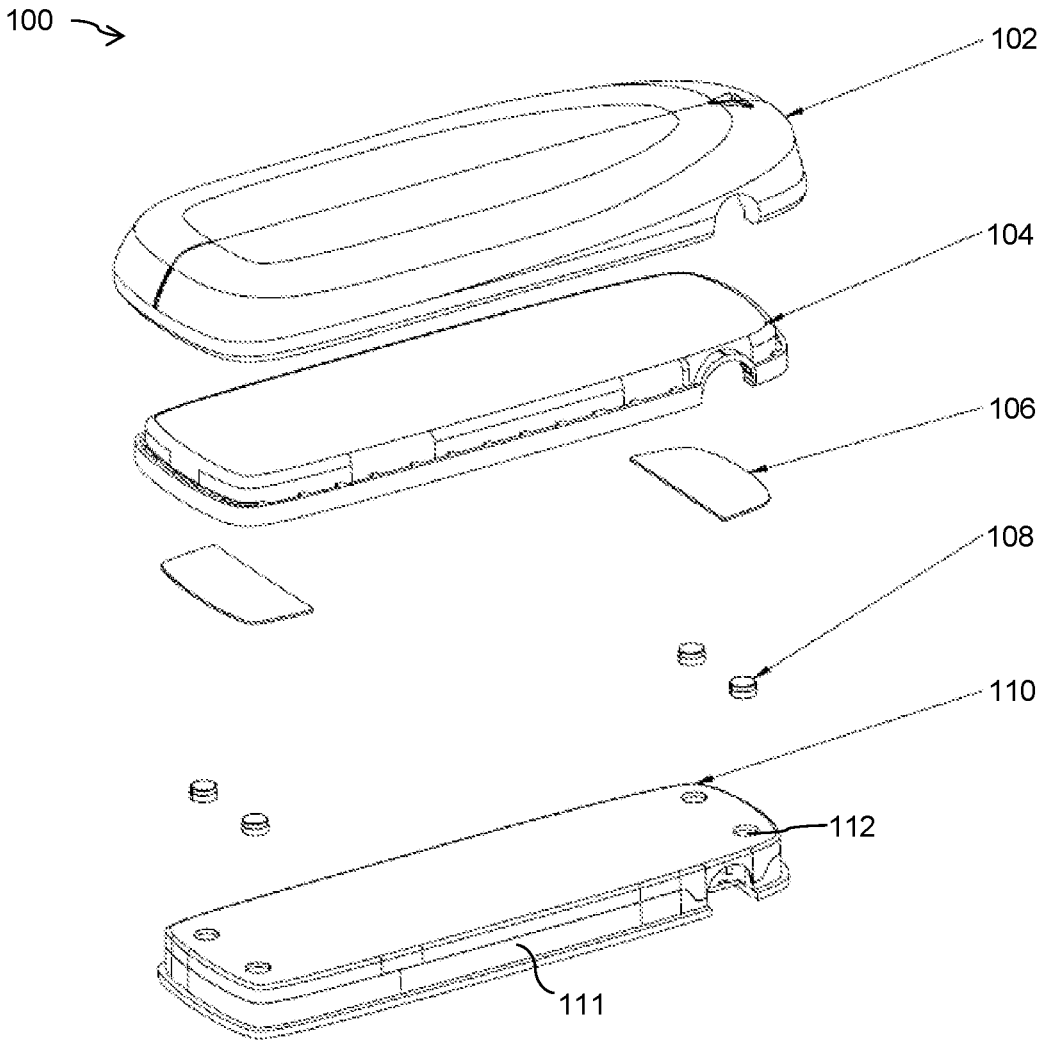
FIG. 1A is an exploded perspective view of an armrest according to an example embodiment.

Embodiments will be described, by way of example only, with reference to the drawings. Like reference numerals and characters in the drawings refer to like elements or equivalents.

Embodiments of the invention provide an armrest which may be installed at an arm support portion of a chair. The armrest may comprise a member that can be replaceable by the user. This allows the user to replace the armrest without having to replace the entire chair when wear and tear of the armrest occurs. Further, users may customize the armrests according to their preferences. For example, users may customize the design, material, texture, etc. of the armrests.

Figure 1B:
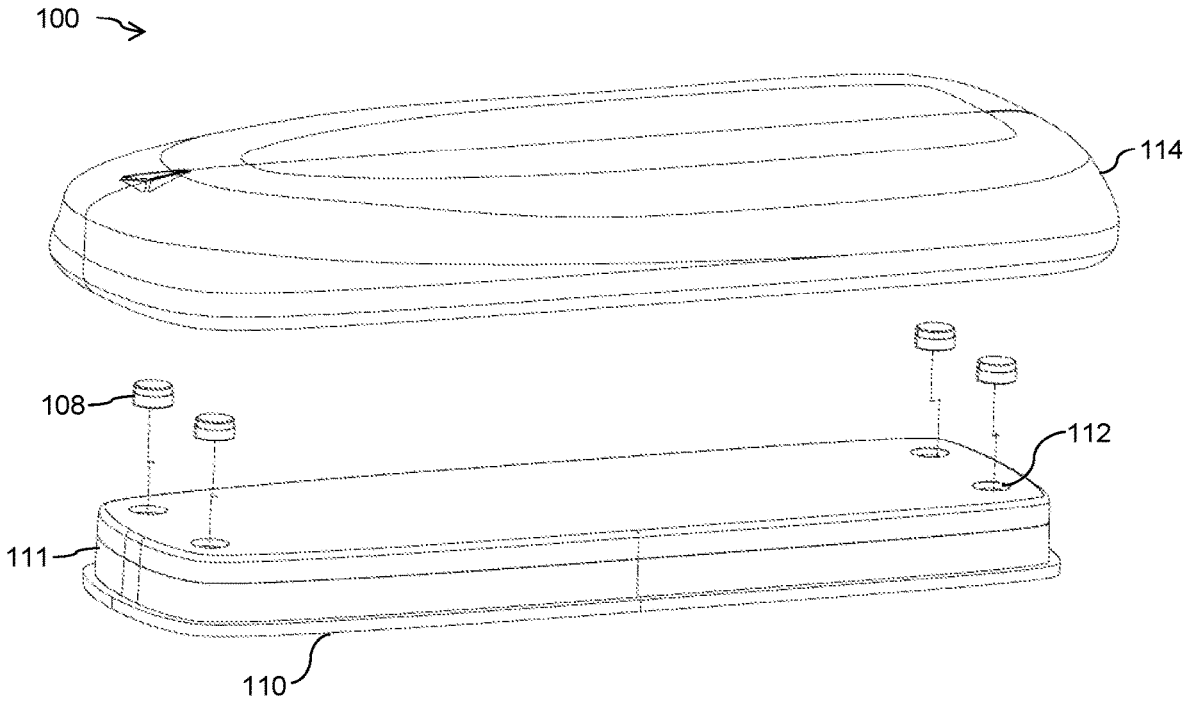
FIG. 1B is a schematic representation of the assembly of magnets in the armrest of FIG. 1A.
Figure 1C:
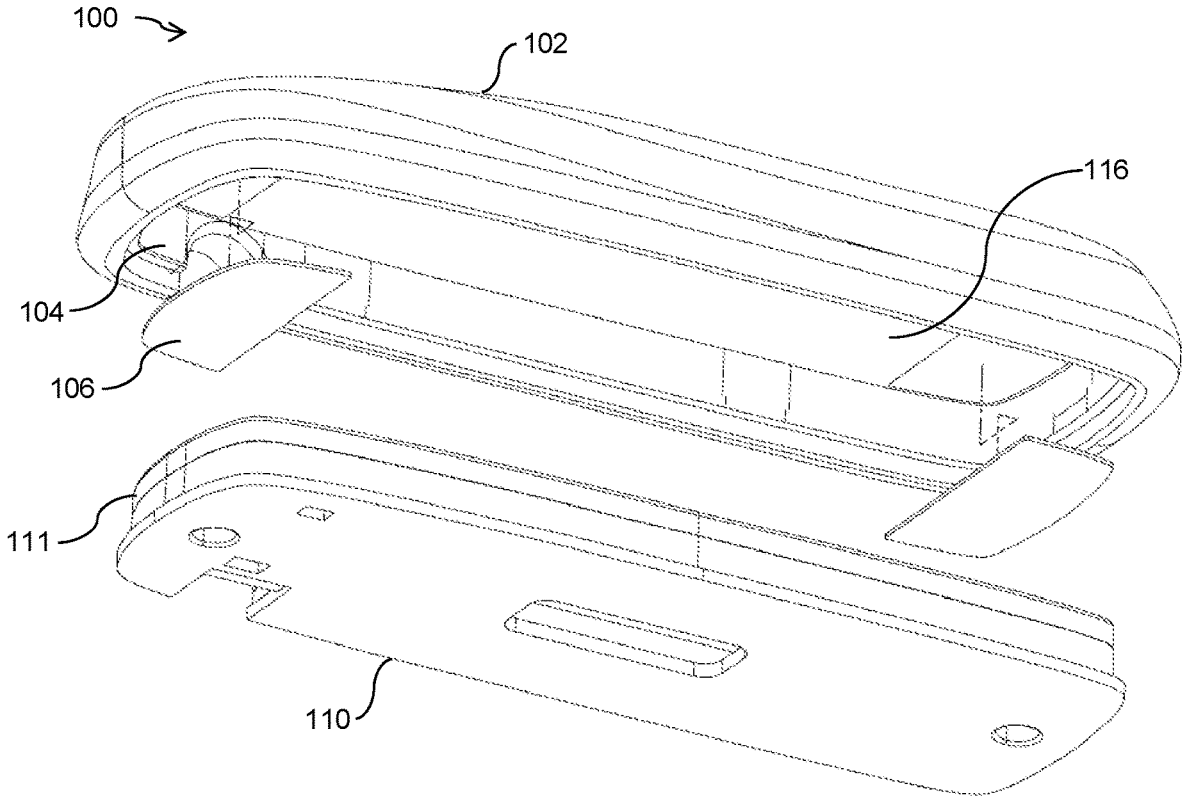
FIG. 1C is a schematic representation of the assembly of steel plates in the armrest of FIG. 1A.

FIG. 1A is an exploded perspective view of an armrest 100 according to an example embodiment. FIG. 1B is a schematic representation of the assembly of magnets and FIG. 1C is a schematic representation of the assembly of steel plates in the armrest of FIG. 1A. The armrest 100 is suitable for a chair and comprises a first member 110. The first member 110 comprises a body 111 extending in a longitudinal direction from a first end to a second end. The body 111 comprises one or more recesses 112, and one or more magnets 108 are disposed in the one or more recesses 112. The armrest 100 also comprises a second member 114 releasably attached to the first member 110. The second member 114 comprises a cavity 116 configured to receive the first member 110 and one or more magnetizable plate members in the form of magnetizable metal sheets 106 disposed in the cavity 116. The one or more magnetizable metal sheets 106 are adjacent the one or more magnets 108 when the first member 110 is received in the cavity 116.

The cavity 116 of the second member 114 may be configured based on the structure of the first member 110 such that the first member 110 can fit snugly in the cavity 116. In other words, the body 111 of the first member 110 comprises a geometry matching a geometry of the cavity 116 for retaining the first member 110 against lateral movement when the first member 110 is received in the cavity 116. This reduces or minimizes possible movement of the second member 114 against the first member 110 when the armrest is in use, hence may improve user experience. Further, as mentioned above, the magnetizable metal sheet(s) 106 of the second member 114 are adjacent the magnet(s) 108 of the first member 110 when the first member 110 is assembled with the second member 114. The magnetic attraction created between the magnetizable metal sheet(s) 106 and the magnet(s) 108 may allow the first member 110 and second member 114 to be kept in position, thereby further reducing or minimizing possible movement of the second member 114 against the first member 110 when the armrest is in use. As such, user experience may be further enhanced.

In some implementations, there may be two magnetizable metal sheets 106. Each of the magnetizable metal sheet 106 may be disposed at each longitudinal end of the second member 114. For example, the magnetizable metal sheets 106 may be ferritic steel plates. Further, there may be four recesses 112 and four magnets 108, each magnet 108 disposed in one recess 112. The recesses 112 and magnets 108 may be positioned based on the positions of the magnetizable metal sheets 106. For example, in the scenario that a magnetizable metal sheet 106 is disposed at each longitudinal end of the second member 114, two recesses 112 and two magnets 108 may be positioned at each longitudinal end of the first member 110 accordingly. The number of magnetizable metal sheets and magnets can vary in alternate embodiments.

Each of the recesses 112 may be configured based on the shape of the magnets 108 such that each magnet 108 can fit snugly in the recess 112. In other words, the magnets 108 are securely retained in the respective recesses 112.

The second member 114 includes a shell 104 and a cover 102 disposed on the shell 104, the shell 104 defining the cavity 116. The one or more magnetizable plate members in the form of magnetizable metal sheets 106 may be fixedly attached to the shell 104, and the one or more magnets 108 may be securely retained in the one or more recesses 112. The magnetizable metal sheets 106 can be fixedly attached to the shell 104 by means of over molding, welding, gluing, etc. In some implementations, the shell 104 may comprise one or more recesses structured based on the shape and thickness of the one or more magnetizable metal sheets 106 such that the magnetizable metal sheets 106 can fit snugly in the respective recesses. Further, by fabricating the depth of the recesses to match the thickness of the magnetizable metal sheets 106, the assembled armrest can be more compact.

According to one embodiment, the cover 102 may be releasably attached to the shell 104. This allows a user to replace the cover 102 when wear and tear occurs or when the user wishes to install a customized cover 102 with a design, material, texture, etc. of his/her preference. To replace the cover 102, the user can manually pull the cover 102 away from the shell 104 to dislodge the cover 102 from the shell 104. The new cover 102 can then be installed by positioning it over the shell 104 and exerting a force in a downwards direction such that it snaps into place with the shell 104.

According to another embodiment, the cover 102 may be fixedly attached to the shell 104. When wear and tear occurs or when a user wishes to customize the armrest, the user can replace the entire second member 114 comprising both the cover 102 and the shell 104. To replace the second member 114, the user can manually overcome the magnetic attraction created between the magnetizable metal sheet(s) 106 and the magnet(s) 108 by pulling the second member 114 away from the first member 110 to dislodge the second member 114 from the first member 110. The new second member 114 can then be installed by positioning it over the first member 110. The magnetic attraction created between the magnetizable metal sheet(s) 106 of the new second member 114 and the magnet(s) 108 of the first member 110 can keep the new second member 114 and the first member 110 in position.

The shell 104 may comprise a composite material such as nylon-glass fiber composite. For example, the nylon-glass fiber composite can be Polyamide 6 (Nylon 6) combined with 20 percent glass fiber. The cover 102 disposed on the shell 104 may comprise polyurethane foam. According to another embodiment, the cover 102 may comprise thermoplastic polyurethane.

Figure 2:
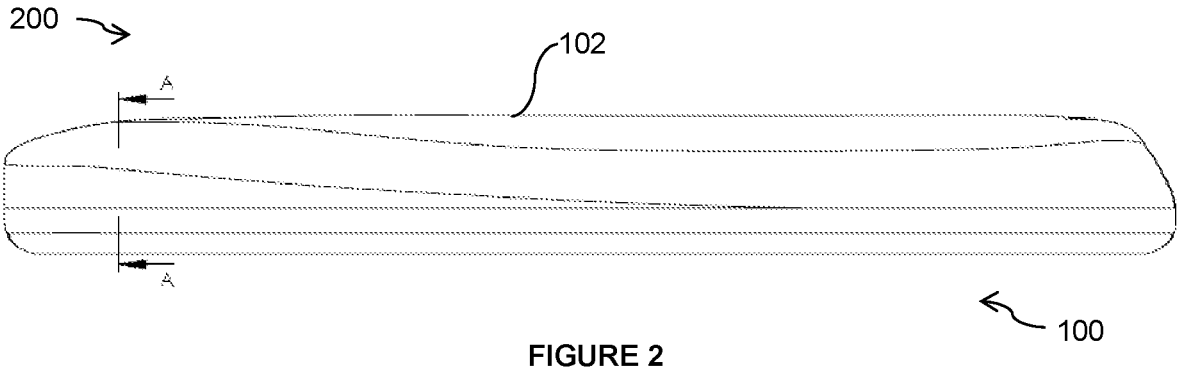
FIG. 2 is a side view of the armrest of FIG. 1.
Figure 3:
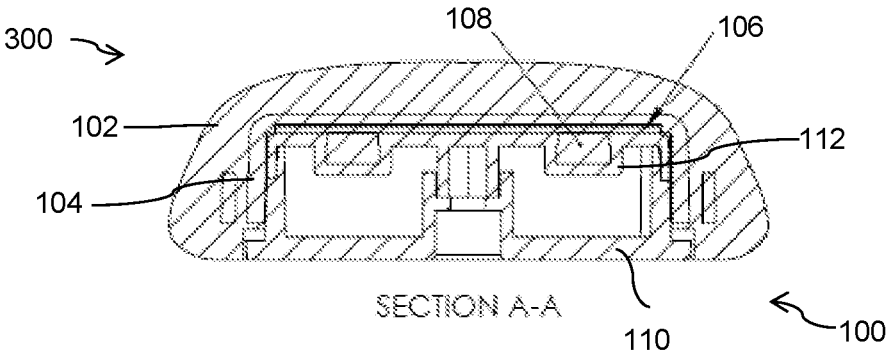
FIG. 3 is a cross-sectional view of the armrest of FIG. 1.

FIG. 2 is a side view 200 of the armrest 100 of FIG. 1 and FIG. 3 is a cross-sectional view 300 of the armrest 100 of FIG. 1. In one implementation, the body 111 of the first member 110 includes a small gradient and the cavity 116 includes a corresponding gradient (the opening of the cavity 116 is slightly wider than the bottom of the cavity 116), such that assembly of the body 111 into the cavity can be made easier while a snug fit can be achieved when assembly is completed. As shown in the figures, when fully assembled, the first member 110 and second member 114 can be snugly fitted. Further, the fully assembled armrest can be compact.

Figure 4A:
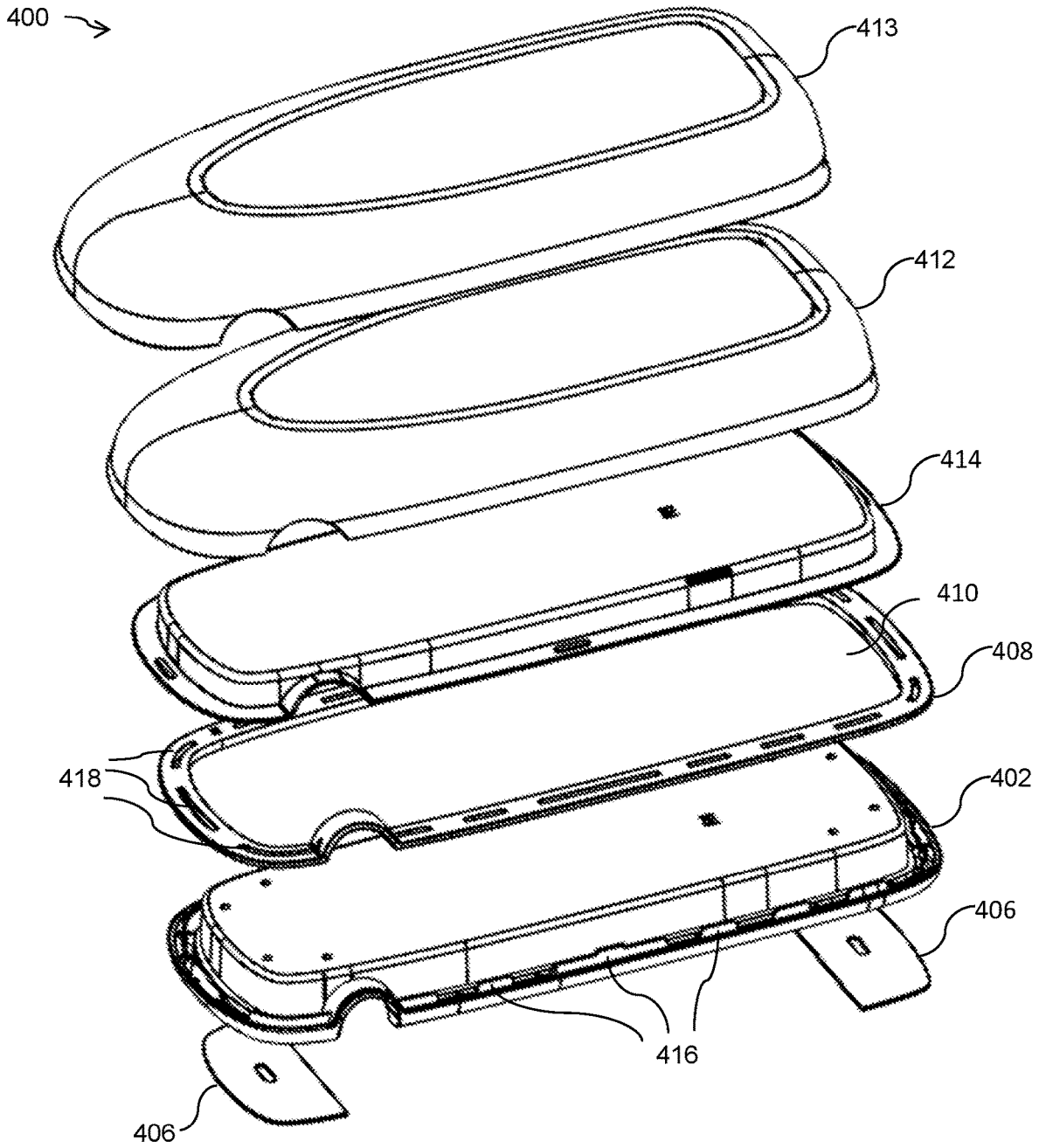
FIG. 4A is an exploded perspective view of a second member of the armrest of FIG. 1 according to an alternate embodiment.
Figure 4B:
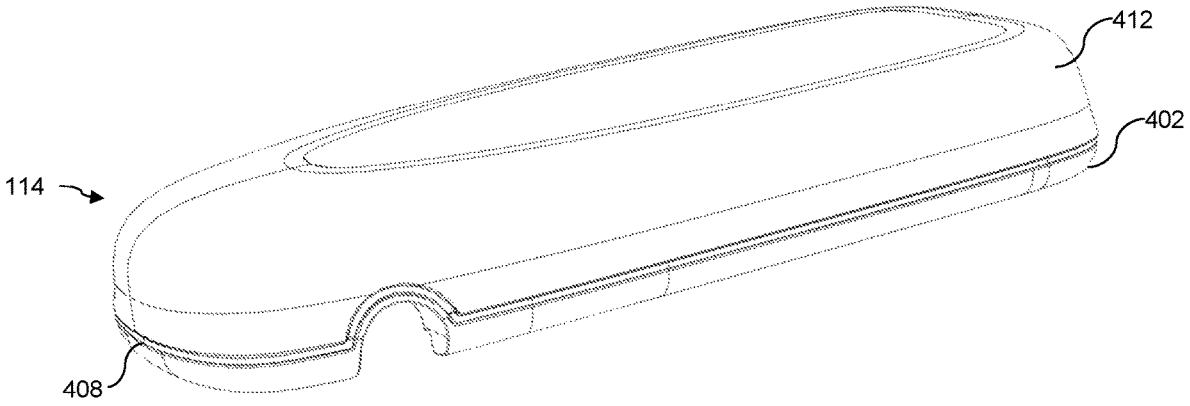
FIG. 4B is a perspective view of the assembled second member of FIG. 4A.

FIG. 4A is an exploded perspective view of a second member 400 of the armrest 100 of FIG. 1 according to an alternate embodiment while FIG. 4B is a perspective view of the assembled second member 400 of FIG. 4A. In this embodiment, the second member 400 includes a bottom housing 402 defining a cavity 404 (see FIG. 6) configured to receive the first member 110 (see FIG. 1A). The bottom housing 402 also includes one or more magnetizable plate members 406 disposed in the cavity 404. The one or more magnetizable plate members 406 are similar to the magnetizable plate members 106 as shown in FIG. 1A and they are adjacent to the one or more magnets 108 (see FIG. 1A) when the first member 110 is received in the cavity 404. The second member 400 further includes a rim member 408 disposed on the bottom housing 402. The rim member 408 may have an opening 410 shaped such that the rim member 408 is disposed around a periphery of the bottom housing 402 when assembled.

For example, the opening 410 of the rim member 408 comprises a geometry matching a geometry of a wall on the bottom housing 402 that forms the cavity 404 for retaining the bottom housing 402 against relative lateral movement when the rim member 408 is assembled on the periphery of the bottom housing 402. The bottom housing 402 may include a plurality of protrusions 416 disposed along the periphery. The rim member 408 may include a plurality of grooves 418 configured to receive the corresponding plurality of protrusions 416 of the bottom housing 402 to securely attach the rim member 408 to the bottom housing 402. In an alternate embodiment, the rim member 408 may include a plurality of protrusions (not shown) while the bottom housing 402 may include a plurality of grooves (not shown) to securely attach the rim member 408 to the bottom housing 402. Other engagement mechanisms are possible. The rim member 408 and the bottom housing 402 may be made from the same material, such as plastic, while having different surface finishes and/or colours. Having the same material may provide the user with a better hand feel on the second member 400 as one seamless surface. Having a different surface finish and/or colour may allow customization, for example, a glossy rim that contrasts with a matt bottom housing, or a colour that matches with a theme or decoration of the chair or adjacent furniture. It can be appreciated that the rim member 408 and the bottom housing 402 may be made from different materials. For example, the rim member 408 may be made from plastic while the bottom housing 402 may be made from metal, or vice versa.

Figure 6:
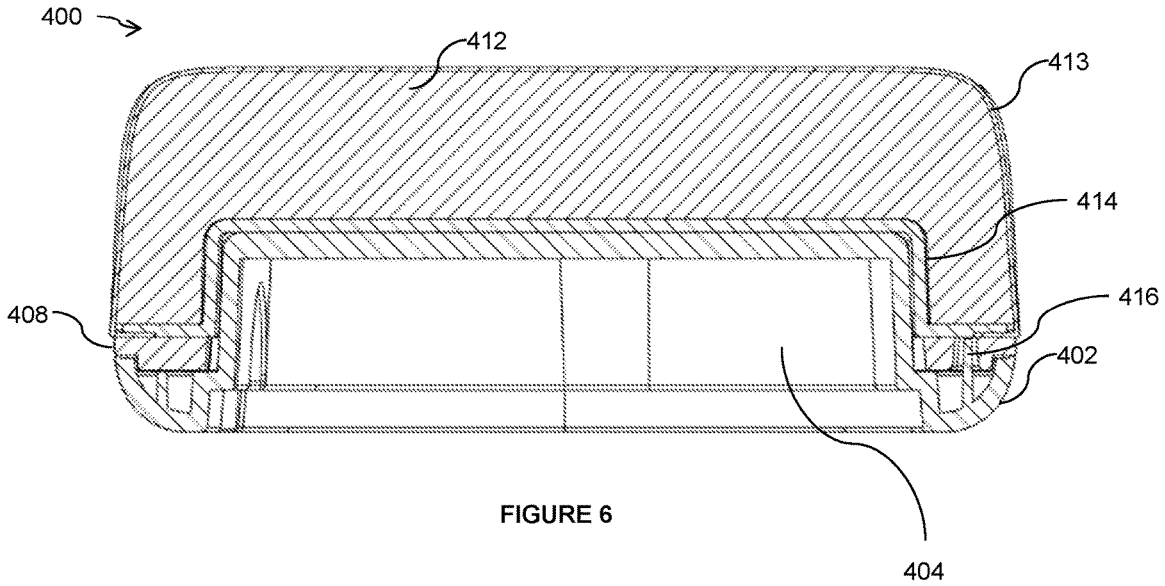
FIG. 6 is a cross-sectional view of the assembled second member of FIG. 4B.

The second member 400 further includes a cushion member 412 disposed on the rim member 408 and configured to abut at least a surface of the cavity 404 to snugly fit over the bottom housing 402. The cushion member 412 may be covered in upholstery 413 and may include a base plate 414 disposed at a lower surface to abut a surface of the bottom housing 402 that forms the cavity 404. In one implementation, the base plate 414 may be removably attached to the cushion member 412. In an alternate implementation, the base plate 414 may be fixedly attached to the cushion member 412 to form a single component. In an example embodiment, the cushion member 412 may be made of a memory foam material, which can retain a certain profile matching the arm position of a frequent user. As a non-limiting example, the memory foam cushion may have a height that is approximately 2 cm thicker than one made of polyurethane foam so that it can accommodate the compression which can be 10 mm when a user exerts a point force of approximately 100 N. The memory foam may be designed to have a safety factor of 1.5 to ensure that the user would not feel the supporting bottom housing 402 under normal usage. Compared to the embodiment shown in FIG. 3, the cushion member 412 in the embodiment shown in FIG. 6 is significantly thicker, and may therefore provide a more luxurious hand feel to the user. It can be appreciated that the memory foam may have a different height and be deformed by more or less than 10 mm depending on the force exerted by the user. The deformation may also depend on the memory foam, for example, its density. Accordingly, it can be envisioned that the second member 400 for a "Medium"-sized chair may have the cushion member 412 of different thickness and/or density compared to one for a "Large"-size chair.

Figure 5:
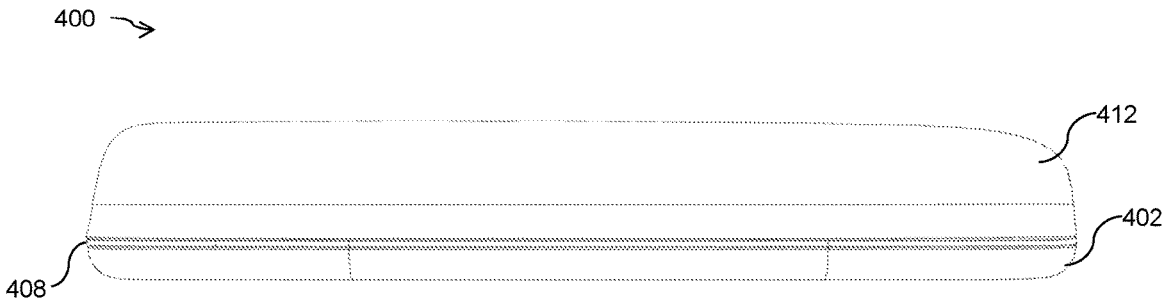
FIG. 5 is a side view of the assembled second member of FIG. 4B.

FIG. 5 is a side view of the assembled second member 400 of FIG. 4B while FIG. 6 is a cross-sectional view of the assembled second member 400 of FIG. 4B. The bottom housing 402, the rim member 408 and the cushion member 412 may be designed for the user to feel the assembled second member 400 as a unitary construction. For example, the bottom housing 404, rim member 408, base plate 414 and cushion member 412 may be fixedly attached to each other to provide a stable, premium feel. This can reduce discernment of the different surfaces of the bottom housing 402, the rim member 408 and the cushion member 412 when the user places their hand across the front of the armrest 100. In alternate embodiments, at least the rim member 408 and the cushion member 412 may be detachable to facilitate customisation and repair/replacement. Preferably, the rim member 408 and the bottom housing 402 may be designed to be shorter longitudinally and the memory foam may be thicker so that the user's hand can feel more of the memory foam than the plastic bodies of the bottom housing 402 and the rim member 408. That is, the user's hand is less likely to contact the plastic bodies and more likely to contact the memory foam. Alternatively or in addition, the thickness of the rim member 408 and/or its edge finishing may be chosen to reduce any sharpness at the edge.

It will be appreciated by a person skilled in the art that numerous variations and/or modifications may be made to the present invention as shown in the specific embodiments without departing from the spirit or scope of the invention as broadly described. For example, the exact dimensions of the armrest may vary depending on the dimensions of the chair. The present embodiments are, therefore, to be considered in all respects to be illustrative and not restrictive.

The invention claimed is:

1. An armrest for a chair, comprising:
- a first member, the first member comprising:
  - a body extending in a longitudinal direction from a first end to a second end, wherein the body comprises one or more recesses; and
  - one or more magnets disposed in the one or more recesses; and
- a second member releasably attached to the first member, the second member comprising:
  - a cavity configured to receive the first member; and
  - one or more magnetizable plate members disposed in the cavity, wherein the one or more magnetizable plate members are adjacent the one or more magnets when the first member is received in the cavity, wherein the second member is releasable from the first member by overcoming a magnetic attraction between the one or more magnets and the one or more magnetizable plate members.

2. The armrest as claimed in claim 1, wherein the second member comprises a shell and a cover disposed on the shell, the shell defining the cavity.

3. The armrest as claimed in claim 2, wherein the one or more magnetizable plate members are fixedly attached to the shell, and the one or more magnets are securely retained in the one or more recesses.

4. The armrest as claimed in claim 2, wherein the cover is releasably attached to the shell.

5. The armrest as claimed in claim 2, wherein the cover is fixedly attached to the shell.

6. The armrest as claimed in claim 2, wherein the shell comprises nylon-glass fiber composite and the cover disposed on the shell comprises polyurethane foam.

7. The armrest as claimed in claim 2, wherein the shell comprises nylon-glass fiber composite and the cover disposed on the shell comprises thermoplastic polyurethane.

8. The armrest as claimed in claim 1, wherein the body of the first member comprises a geometry matching a geometry of the cavity for retaining the first member against lateral movement when the first member is received in the cavity.

9. An armrest for a chair, comprising:

a first member having a body comprising one or more recesses, each of the one or more recesses configured to securely retain a corresponding magnet; and a second member releasably attached to the first member, the second member comprising:

a bottom housing defining a cavity, the cavity configured to receive the first member;

one or more magnetizable plate members disposed in the cavity, the one or more magnetizable plate members being adjacent the one or more magnets when the first member is received in the cavity;

a rim member disposed on a periphery of the bottom housing; and a cushion member disposed on the rim member and configured to abut at least a surface of the bottom housing forming the cavity to snugly fit over the bottom housing.

10. The armrest as claimed in claim 9, wherein the cushion member is made of a memory foam material.

11. The armrest as claimed in claim 9, wherein the second member further comprises a base plate disposed at a lower surface of the cushion member and configured to abut the surface of the bottom housing forming the cavity.

12. The armrest as claimed in claim 11, wherein the base plate is removably attached to the cushion member.

13. The armrest as claimed in claim 9, wherein the rim member and the bottom housing are made from the same material.

14. The armrest as claimed in claim 9, wherein the rim member and the bottom housing have different surface finishes.

15. The arm rest as claimed in claim 9, wherein the rim member and the bottom housing have different colours.

16. The armrest as claimed in claim 9, wherein the bottom housing comprises a plurality of protrusions disposed along the periphery.

17. The armrest as claimed in claim 16, wherein the rim member comprises a corresponding plurality of grooves configured to receive the plurality of protrusions of the bottom housing to securely attach the rim member to the bottom housing.

18. The armrest as claimed in claim 9, wherein the second member further comprises an upholstery configured to cover the cushion member.

* * * * *